US009090317B2

(12) United States Patent
Mulvihill

(10) Patent No.: US 9,090,317 B2
(45) Date of Patent: Jul. 28, 2015

(54) FLOTATION DEVICE HAVING A WINDOW AND A MASK TO PERMIT A USER TO VIEW BELOW THE WATER

(71) Applicant: Thomas Charles Mulvihill, Sarasota, FL (US)

(72) Inventor: Thomas Charles Mulvihill, Sarasota, FL (US)

( * ) Notice: Subject to any disclaimer, the term of this patent is extended or adjusted under 35 U.S.C. 154(b) by 105 days.

(21) Appl. No.: 13/866,988

(22) Filed: Apr. 19, 2013

(65) Prior Publication Data

US 2013/0280974 A1 Oct. 24, 2013

Related U.S. Application Data

(60) Provisional application No. 61/637,846, filed on Apr. 24, 2012.

(51) Int. Cl.

| | |
|---|---|
| ***B63C 11/00*** | (2006.01) |
| ***B63B 35/73*** | (2006.01) |
| ***B63C 11/49*** | (2006.01) |
| *B63B 35/79* | (2006.01) |

(52) U.S. Cl.

CPC ..... *B63B 35/73* (2013.01); *B63C 11/49* (2013.01); *B63B 2035/7903* (2013.01)

(58) Field of Classification Search

CPC .. B63C 11/49; B63B 35/73; B63B 2035/7903
USPC ..... 441/135; 114/66; 359/595
See application file for complete search history.

(56) References Cited

U.S. PATENT DOCUMENTS

| | | | | |
|---|---|---|---|---|
| 2,712,139 | A * | 7/1955 | Kelly | 441/135 |
| 2,717,399 | A | 9/1955 | Backhouse | |
| 2,926,365 | A * | 3/1960 | Wilcoxon | 441/135 |
| 3,042,945 | A * | 7/1962 | Saeman | 441/135 |
| 3,081,726 | A * | 3/1963 | Betts et al. | 114/66 |
| 3,808,621 | A | 5/1974 | French | |
| 4,145,783 | A | 3/1979 | Rhodes | |
| 4,228,751 | A | 10/1980 | Robertson et al. | |
| 4,691,658 | A * | 9/1987 | New et al. | 114/66 |
| 4,840,592 | A * | 6/1989 | Anderson | 441/135 |
| 4,844,595 | A * | 7/1989 | Nealy | 359/895 |
| 4,895,539 | A | 1/1990 | Bender | |
| 4,925,417 | A * | 5/1990 | Warren | 441/65 |
| D315,387 | S | 3/1991 | Warren | |
| 5,476,055 | A * | 12/1995 | Hackett et al. | 114/66 |
| D377,072 | S | 12/1996 | Ilejay | |
| 5,595,133 | A | 1/1997 | Bullard | |
| 5,672,082 | A | 9/1997 | Binder | |
| 6,033,276 | A | 3/2000 | Han | |
| 6,142,844 | A | 11/2000 | Klauber | |
| 6,241,569 | B1 * | 6/2001 | Harkrider | 441/135 |
| 6,247,811 | B1 | 6/2001 | Rhoades et al. | |

(Continued)

*Primary Examiner* — Daniel V Venne

(57) ABSTRACT

A form-fitting comfortable mask, or sun screen, can be disposed, in tension, over a viewing compartment of a flotation device. The floatation device can provide the viewer with a safe, light and water resistant compartment that will greatly enhance their viewing of underwater details while minimizing or eliminating impact to their face from rough water conditions. The flotation device is designed to incorporate a tension surface with molded, water and light resistant air vents that support and secure a Neoprene and/or fabric sun screen mask with molded fasteners in a way that positions the sun screen/mask above the clear glass and/or plastic window. A hidden snorkel system between the viewing window and tension surface provides a fresh supply of clean air while restricting light and water from entering the viewing compartment.

14 Claims, 2 Drawing Sheets

(56) References Cited

U.S. PATENT DOCUMENTS

| | | | | |
|---|---|---|---|---|
| 6,293,841 | B1 | 9/2001 | Safilian | |
| 6,572,424 | B2 * | 6/2003 | Harkrider | 441/135 |
| 7,507,132 | B2 | 3/2009 | Grune et al. | |
| 7,547,238 | B1 * | 6/2009 | Melancon | 441/135 |
| 7,927,164 | B2 * | 4/2011 | Kuchler | 441/135 |
| 2006/0035545 | A1 | 2/2006 | Boley et al. | |
| 2011/0239347 | A1 | 10/2011 | Beliveau | |

* cited by examiner

FLOTATION DEVICE HAVING A WINDOW AND A MASK TO PERMIT A USER TO VIEW BELOW THE WATER

CROSS-REFERENCE TO RELATED APPLICATION

This application claims the benefit of priority of U.S. provisional application No. 61/637,846, filed Apr. 24, 2012, the contents of which are herein incorporated by reference.

BACKGROUND OF THE INVENTION

The present invention relates to flotation devices and, more particularly, to a flotation device with a clear window and a sunscreen/mask that allows a user to view below the water without a conventional mask or snorkel.

Many people are not comfortable with floating face down in the water and breathing through a snorkel tube while semi-submerged. They fear the water entering the mask or snorkel. They are also at risk of boaters not seeing them and being injured or killed.

Underwater-viewing flotation devices are plagued by ambient light coming from behind the viewer causing reflections and unwanted sources of light that interfere with viewing details of the underwater environment. This ambient light and these reflections cause the user's pupils to constrict. The detail of the subtle light from underwater is, therefore, not easily seen with the pupils constricted, creating a poor vision of the underwater environment.

Other devices in the field fail to greatly eliminate distracting ambient light, reflections and/or water from entering the viewing compartment, thereby greatly reducing the viewer's ability to view details of the underwater environment. Furthermore, some competitive products offer a hard surface in close proximity to the viewer's eyes, nose and mouth raising the opportunity for injury during rough water conditions.

As can be seen, there is a need for an underwater viewing flotation device.

SUMMARY OF THE INVENTION

In one aspect of the present invention, a flotation device comprises a body member adapted to float in water and support at least a user's torso; a viewing chamber formed in one end of the body member; a viewing window formed on a bottom side of the viewing chamber; a sunscreen/mask disposed over an opening forming the viewing chamber; a raised portion of the sunscreen/mask defining an opening for placing a user's face thereupon to view through the viewing window; and one or more water resistant air vents communicating air between outside the viewing chamber and inside the viewing chamber.

In another aspect of the present invention, a flotation device comprises a body member adapted to float in water and support at least a user's torso; a viewing chamber formed in one end of the body member; a viewing window formed on a bottom side of the viewing chamber; a sunscreen/mask disposed over an opening forming the viewing chamber; a raised portion of the sunscreen/mask defining an opening for placing a user's face thereupon to view through the viewing window; one or more water resistant air vents communicating air between outside the viewing chamber and inside the viewing chamber; hand grips formed on sides of the body member; handles disposed on a front end of the body member; a drain plug formed in the body member; and a shoulder strap attached to the body member at a front end and a rear end thereof.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a form-fitting comfortable mask, or sun screen, in tension over the viewing compartment. The floatation device of the present invention can provide the viewer with a safe, light and water resistant compartment that will greatly enhance their viewing of underwater details while minimizing or eliminating impact to their face from rough water conditions. The flotation device is designed to incorporate a tension surface with unique molded water and light resistant air vents that would support and secure a Neoprene and/or fabric sun screen mask with molded fasteners and/or hook and loop fasteners, such as Velcro® fasteners, in a way that positions the sun screen mask above the clear glass and/or plastic window. A hidden snorkel system between the mask and tension surface provides a fresh supply of clean air while restricting light and water from entering the viewing compartment.

The viewer would position himself/herself on the flotation device in the water environment in a way that would place their face into the sun screen mask and look down through the clear glass and/or plastic window so as to view the underwater environment without the associated reflections, glare and ambient light and or invasive water distraction present in other such devices. The unique water-resistant air vents can provide an adequate supply of fresh air while the viewer's face is place into the form fitting Neoprene and/or fabric sun screen mask. Motion and navigation can be provided by the viewer using their hands, arms and legs, possibly aided by mechanical devices such as flippers. Additionally, the flotation device can be made with a high visibility platform that makes the user more visible to boaters and helps reduce or eliminate injury or death.

Figure 1:
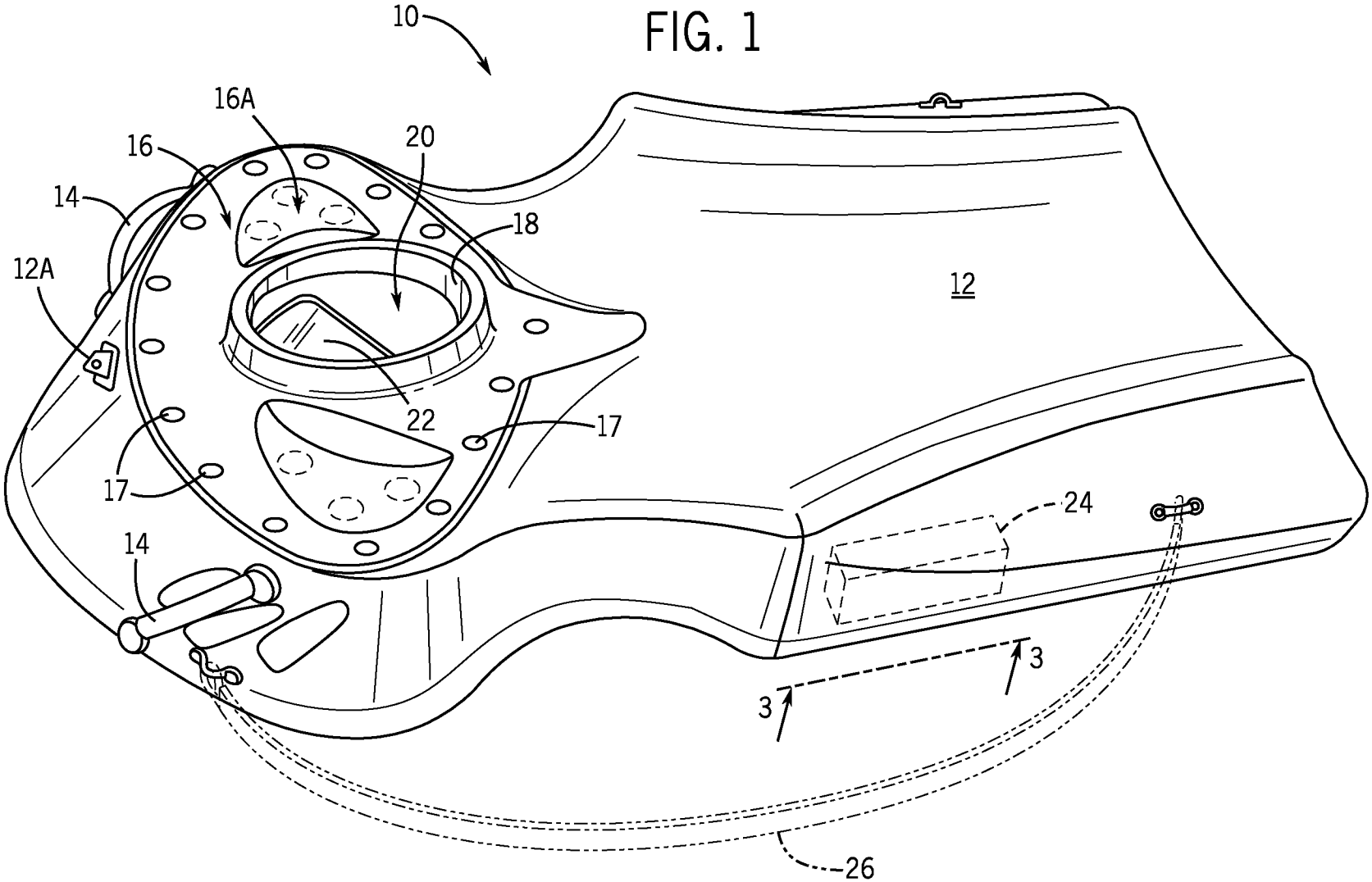
FIG. 1 is a perspective view of a flotation device according to an exemplary embodiment of the present invention.
Figure 2:
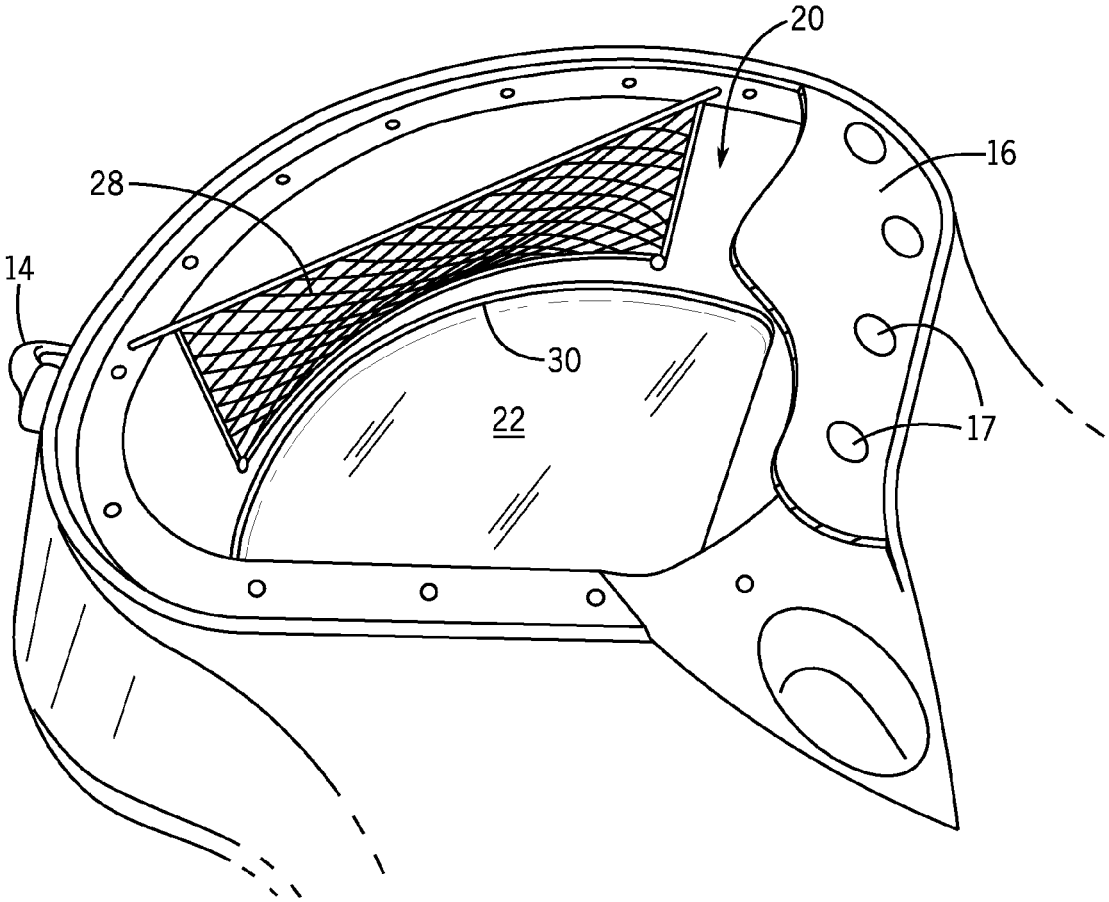
FIG. 2 is a detailed, partially cutaway perspective view of the mask area of the flotation device of FIG. 1.
Figure 3:
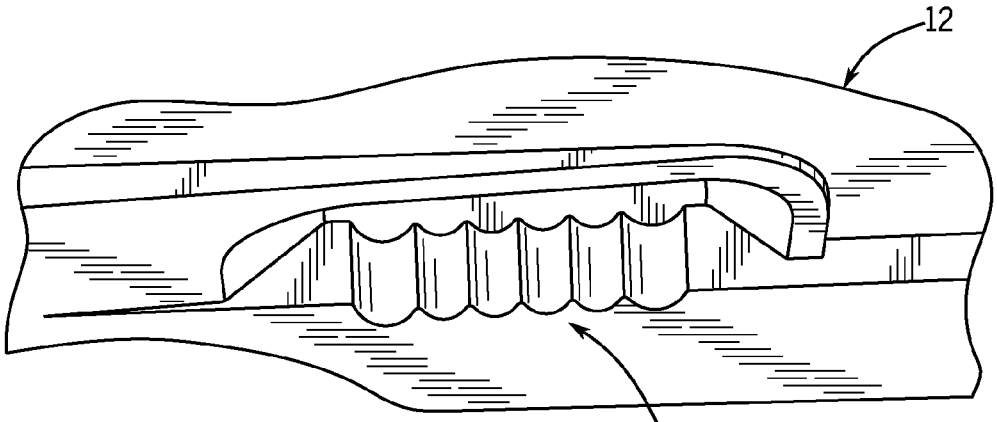
FIG. 3 is a detailed perspective view of a bottom portion, illustration a hand grip, as viewed from 3-3 of FIG. 1.

Referring now to FIGS. 1 through 3, a flotation device 10 can include a floating body member 12 having a sunscreen/mask 16 formed at one end thereof. The sunscreen/mask 16 provides a viewing chamber 20 in the body member 12 with a viewing window 22 disposed on a bottom side of the body member 12 allowing a user to look into the viewing chamber 20 and see into the water on which the flotation device 10 is floating. A gasket/seal 30 can be formed between the viewing window 22 and the body member 12 to prevent entry of water into the viewing chamber 20 during use. The sunscreen/mask 16 can be attached to the body member 12 with a plurality of mounting devices 17, such as hooks, snaps, hook and loop fasteners, or the like. A drain plug 12A can be provided in the body member 12 to permit draining of any water that may accumulate in the flotation device 10.

The body member 12 is designed to support a torso of a user. When resting supine on the body member 12, the user can rest their face on a raised portion 18 of the sunscreen/mask 16. The raised portion 18 can provide a virtual light-tight seal to the user's face, blocking ambient light from entering the viewing chamber 20 and eliminating view-restricting reflections. Water resistant air vents 16A are provided in the sunscreen/mask 16 to permit fresh air to enter the viewing chamber 20. The air vents 16A can take various forms and designs within the scope of the present invention.

The bottom side of the flotation device 10 can include hand grips 24 molded into the body member 12. The hand grips 24 can be used, for example, to help carry the flotation device 10. Two sturdy handles 14 can be attached to the front of the flotation device 10. The sturdy handles 14 can be used, for example, by a user to position themselves on and off the flotation device 10.

A plurality of eyelets can be disposed on the flotation device 10 for holding any number of accessories. For example, a carrying strap 26 can be attached between eyelets at a front end and a rear end of the flotation device 10. Other accessories are described in greater detail below.

Navigation and propulsion is provided by the viewer using their hands, arms, legs and mechanical devices such as flippers. The complete assembly functions much like snorkel gear but with features that allow the person's face to remain out of the water and with no need to breathe through a tube held between the teeth. Additional comfort can be provided by incorporating a high-visibility flotation device, a high-visibility safety flag and a wrist strap to secure the flotation device to the viewer.

There are optional components that include a deflector that can be used if, and when, the flotation device is used in rough water conditions and additional water deflection is desired around the head and face from waves or spray coming over the tension surface of the flotation device. Additional optional equipment include, but are not limited to the following: a leash secured to the flotation device and secured to the viewer by, for example, Velcro® fasteners, to the wrist or forearm; a safety flag attached to a fiberglass pole mounted to the flotation device in a way to provide added visual presence while floating on the water's surface; a cargo net 28 within the viewing compartment that will help secure loose articles such as sunglasses or cell phones (when sealed inside clear flotation dry bags) if and when the viewer needs to secure such items; a neoprene and/or fabric body pad to make the surface of the flotation device more comfortable and/or less slippery; a mono-filament line, weight, swivel and hook can be hung at various depths from the nose of the flotation device and utilized with bait to attract small fish for the purpose of viewing or photographing; a battery powered propulsion system for moving the flotation device along in the water; and a graphics package can be applied to the bottom of the flotation device that mimics the colors and patterns of poisonous fish in a way that may deter an attack by a large fish upon the flotation device.

While specifically designed to be used as a recreational device to view underwater environments for pleasure and to the extent of an operator's safe ability to operate it, the device could be employed in a marina or mooring area to locate tools or other personal property that may have been dropped into the water.

Additionally, the device could be used to inspect and photograph submerged equipment such as, but not limited to, propellers, pumps, drainage systems, mooring lines, anchors and piers. It is possible to use the flotation device with tools in order to scrape or remove barnacles from various submerged surfaces. The device can be used as a therapeutic or rehabilitation aid in large swimming pools where people are urged to use their arms and legs to propel themselves in water and to follow the lines as frequently painted on the bottom of such pools. Many people aren't comfortable with goggles and/or keeping their face in the water. This device can help them stay in their lane.

Similarly, this device can be used by schools or other recreational groups for youth racing programs where they are currently using kick-boards. Kick-boards do not generally allow the swimmer to see the lines at the bottom of the pool.

It should be understood, of course, that the foregoing relates to exemplary embodiments of the invention and that modifications may be made without departing from the spirit and scope of the invention as set forth in the following claims.

What is claimed is:

1. A flotation device floating in water and supporting a user, the user having a torso and a face, the flotation device, comprising:

a body member adapted to float in water and support the torso of the user;

a viewing chamber formed in one end of said body member;

a viewing window formed on a bottom side of said viewing chamber;

an opening formed on a top side of said viewing chamber, a screen disposed over said opening for forming said viewing chamber;

said screen defining a tension surface for eliminating impact to the face of the user from rough water conditions;

a raised portion in said screen defining an opening for receiving the face thereupon to view through the viewing window and provide a light tight seal to the face; and said screen and said raised portion including a fabric.

2. A flotation device as set forth in claim 1, wherein said fabric includes a neoprene material.

3. A flotation device as set forth in claim 1, wherein said screen includes an air vent permitting air to enter said viewing chamber and restricting light and water from entering said viewing chamber; and said air vent including a fabric.

4. A flotation device as set forth in claim 1, wherein said screen is removably attached to said body member by a plurality of mounting devices.

5. A flotation device as set forth in claim 1, further including a cargo net within said viewing chamber for securing loose articles.

6. The flotation device as set forth in claim 1, further including a hand grip on a bottom side of said body member to help carry the flotation device.

7. The flotation device as set forth in claim 1, further including a handle on a front of said body member for positioning the user on and off the flotation device.

8. The flotation device as set forth in claim 1, further including a drain plug in said body member for draining water in the flotation device.

9. The flotation device as set forth in claim 1, further including a plurality of eyelets attached to a front end and a rear end of said body member; and a carrying strap attached to said plurality of eyelets.

10. The flotation device as set forth in claim 1, further including a pad attached to a surface of said body member for increasing comfort and/or decreasing slippage.

11. A flotation device floating in water and supporting a user, the user having a torso and a face, the flotation device, comprising:

a body member adapted to float in water and support the torso of the user;

a viewing chamber formed in one end of said body member;

a viewing window formed on a bottom side of said viewing chamber;

an opening formed on a top side of said viewing chamber;

a screen disposed over said opening for forming said viewing chamber;

said screen defining a tension surface for eliminating impact to the face of the user from rough water conditions;

a raised portion in said screen defining an opening for receiving the face thereupon to view through the viewing window and provide a light tight seal to the face; and said screen and said raised portion including a soft form fitting material.

12. A flotation device as set forth in claim 11, wherein said screen includes an air vent permitting air to enter said viewing chamber and restricting light and water from entering said viewing chamber; and said air vent including a soft form fitting material.

13. A flotation device as set forth in claim 11, wherein said screen is removably attached to said body member by a plurality of mounting devices.

14. The flotation device as set forth in claim 11, further including a pad attached to a surface of said body member for increasing comfort and/or decreasing slippage.

* * * * *